United States Patent [19]

Hayashi et al.

[11] Patent Number: 4,878,469

[45] Date of Patent: Nov. 7, 1989

[54] POWER PLANT STRUCTURE FOR MOTOR VEHICLE

[75] Inventors: Yoshimasa Hayashi, Kamakura; Tsuyoshi Tamazawa, Yokohama, both of Japan

[73] Assignee: Nissan Motor Co., Ltd., Yokohama, Japan

[21] Appl. No.: 141,244

[22] Filed: Jan. 6, 1988

[30] Foreign Application Priority Data

Jan. 7, 1987 [JP] Japan ..... 62-581

[51] Int. Cl.[4] ..... F02B 75/06; F02B 75/20

[52] U.S. Cl. ..... 123/195 A; 123/195 AC

[58] Field of Search ..... 123/195 R, 195 A, 195 C, 123/195 H, 195 AC

[56] References Cited

U.S. PATENT DOCUMENTS

| | | | |
|---|---|---|---|
| 4,368,703 | 1/1983 | Shibata | 123/195 A X |
| 4,470,379 | 9/1984 | Miyakoshi et al. | 123/195 R X |
| 4,606,310 | 8/1986 | Makino | 123/195 C X |
| 4,637,354 | 1/1987 | Tominaga et al. | 123/195 R X |
| 4,714,061 | 12/1987 | Nakayama et al. | 123/195 R |

FOREIGN PATENT DOCUMENTS 0053826 4/1983 Japan .

*Primary Examiner*—Willis R. Wolfe

*Attorney, Agent, or Firm*—Pennie & Edmonds

[57] ABSTRACT

Herein disclosed is a power plant structure which generally includes an engine part and a transmission part. In order to increase the rigidity of the power plant structure, the cylinder block of the engine is tightly connected by bolts to a mounting portion integrally formed on a transmission case. For more assured rigidity, a ladder beam structure is tightly disposed between the cylinder block and the mounting portion.

13 Claims, 6 Drawing Sheets

POWER PLANT STRUCTURE FOR MOTOR VEHICLE

BACKGROUND OF THE INVENTION

1. Field of the Invention

The present invention relates in general to an automotive power plant structure which, for producing a drive power and transmitting the power to driven wheels, consists of an engine part and a transmission part, and more particularly, the present invention relates to a low-noise level automotive power plant structure which has a high rigidity in construction to reduce engine noise emitted therefrom.

2. Description of the Prior Art

Japanese Utility Model First Provisional Publication No. 58-53826 shows an internal combustion engine which is constructed rigid for reducing noise emitted therefrom.

As is seen from FIGS. 9, 10, and 11 of the accompanying drawings, the engine disclosed by the publication has a unique construction practically applied thereto. That is, the engine comprises a cylinder block 10 having a lower skirt section 12 which is bulged outwardly and extends downwardly to define thereinside an upper part of a crankcase (no numeral). A plurality of main bearing bulkheads 14 are parallelly aligned and disposed inside of the skirt section 12. Each bulkhead 14 is formed with a bearing section (no numeral).

A ladder beam structure 16 is securely connected to the bottom portion of the cylinder block 10 and includes, as is seen from FIGS. 10 and 11, a plurality of main bearing cap sections 18 each having both ends integrally connected to respective side beam sections 20 and 22. Each bearing cap section 18 is secured at its top portion onto each bearing bulkhead 14 by means of cap bolts 24 so as to associate with the bearing section of the bulkhead 14, thereby forming a cylindrical bore 26 in which the journal of a crankshaft (not shown) is rotatably supported. An oil pan 28 is secured to the bottom portion of the ladder beam structure 16.

With the construction as described hereinabove, the rigidity of the bearing cap sections 18 is increased and the vibration of the skirt section 12 is reduced. Thus, the engine noise can be reduced to a certain low level.

SUMMARY OF THE INVENTION

It is an object of the present invention to provide an automotive power plant structure which is constructed to achieve much more assured noise reduction as compared with the above-mentioned conventional engine construction.

According to the present invention, there is provided a power plant structure wherein a cylinder block of an engine is securely connected by bolts to a mounting portion which is integrally formed on a transmission case.

According to the present invention, there is provided a power plant structure which comprises an engine including a cylinder block, a transmission including a transmission case, a mounting portion integrally formed on the transmission case to mount thereon the cylinder block, connecting means, such as bolts, for securely connecting the cylinder block to the mounting portion, and a part of the transmission case, the part constituting a part of of an oil pan of the engine upon mounting of the engine onto the mounting portion.

BRIEF DESCRIPTION OF THE DRAWINGS

The features and advantages of the power plant structure of the present invention will be more appreciated from the following description when taken in conjunction with the accompanying drawings, in which.

DETAILED DESCRIPTION OF THE INVENTION

For ease of understanding, substantially the same parts and constructions as those of the abovementioned conventional engine are designated by the same numerals in the following description.

Figure 1:
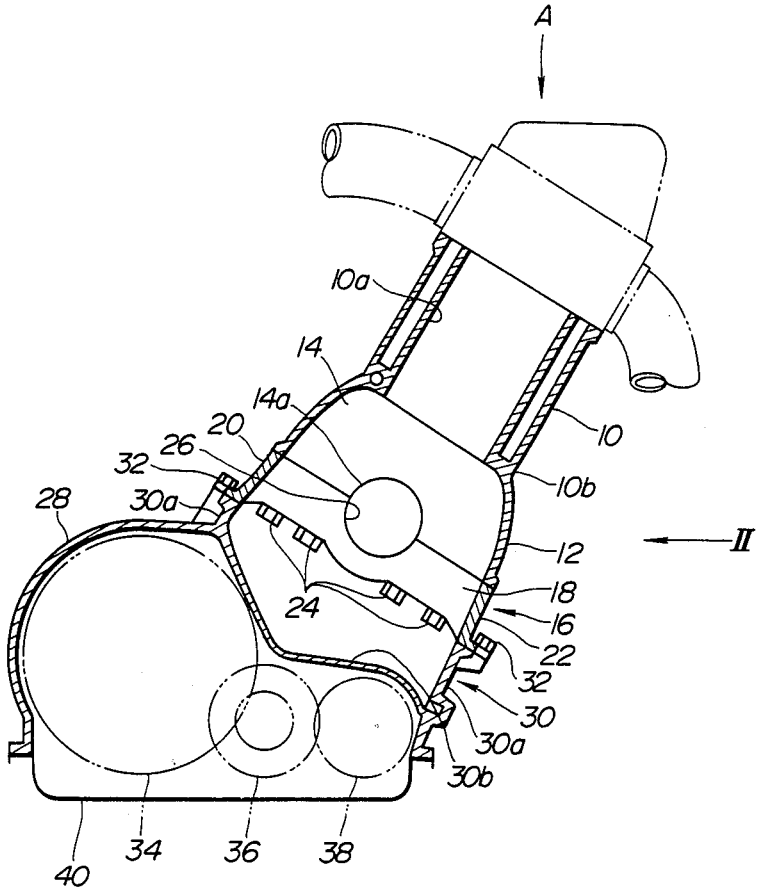
FIG. 1 is a front vertical sectional view of a power plant structure of a first embodiment of the present invention.
Figure 2:
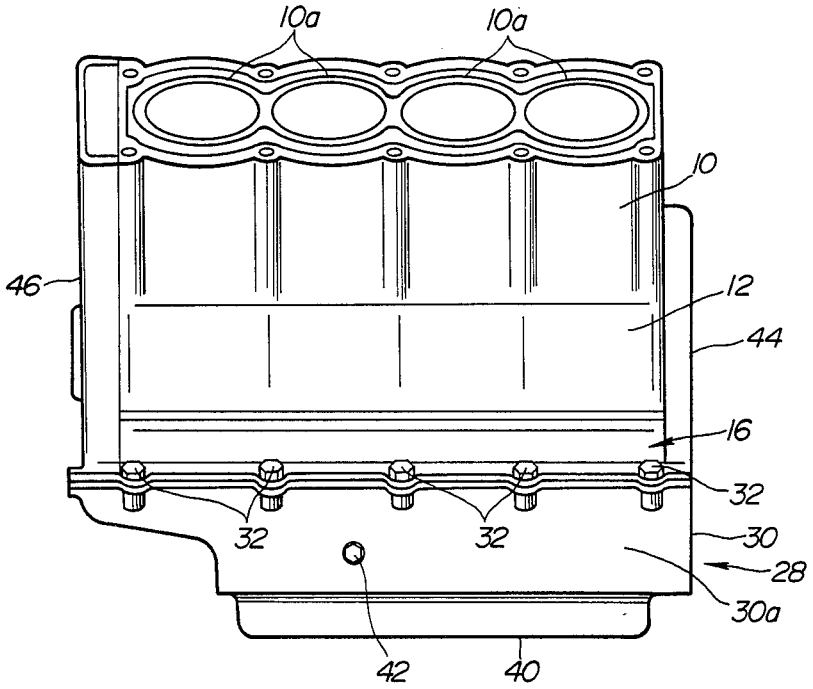
FIG. 2 is a side view of the power plant structure of the first embodiment, which is taken from the direction of the arrow "II" of FIG. 1.
Figure 3:
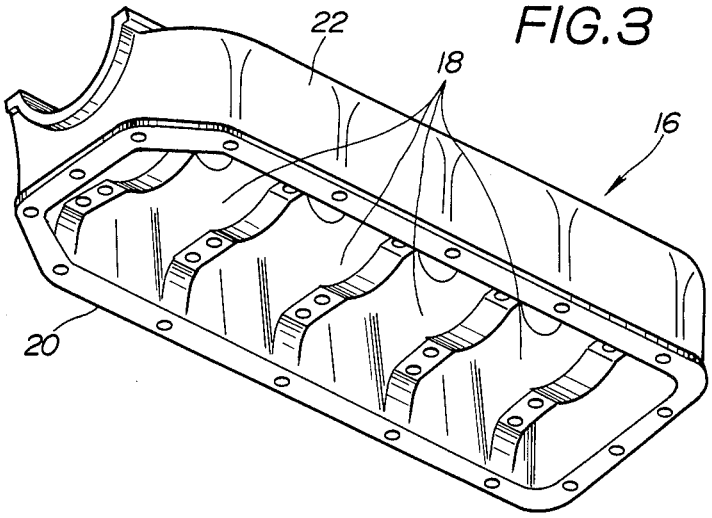
FIG. 3 is a perspective view of a ladder beam structure which is practically applied to some of the power plant structures of the present invention.

Referring to FIGS. 1 to 3, particularly FIG. 1, there is shown a power plant structure of a first embodiment of the present invention, which is generally designated by reference "A".

The power plant structure "A" comprises generally an internal combustion engine part and a transmission part which are rigidly connected with each other in a manner as will be described hereinafter.

The engine part comprises a cylinder block 10 which is formed with a plurality (four in the illustrated embodiment) of cylinder barrels 10a each of which defines therein a cylinder bore (no numeral). The cylinder block 10 includes a skirt section 12 which is bulged outwardly and extends downwardly to define thereinside an upper part of a crankcase (no numeral). The skirt section 12 is integrally connected through a lower block deck 10b with the cylinder barrels 10a. A plurality of main bearing bulkheads 14 are parallelly aligned and disposed inside of the skirt section 12. Each bearing bulkhead 14 is located below and connected to a position between the adjacent two cylinder barrels **10*a*. The bearing bulkhead 14 is integrally connected at its top part with the lower block deck 10*b* and at its side parts with the inner walls of the skirt section 12. Each bearing bulkhead 14 is provided at its bottom central portion with a bearing section 14***a* for rotatably receiving the journal of a crankshaft (not shown).

A ladder beam structure 15 is securely connected to the bottom part of the cylinder block 10, which, as is shown in FIG. 3, includes a plurality of main bearing cap sections 18 each having both ends integrally connected to respective side beam sections 20 and 22. Each bearing cap section 18 is secured at its top portion onto each bearing bulkhead 14 by means of cap bolts 24 (see FIG. 1) so as to associate with the bearing section of the bulkhead 14, thereby forming a cylindrical bore 26 in which the journal of the crankshaft (not shown) is rotatably received.

The ladder beam structure 16 is sealingly seated on a bank of a recessed portion 30 which is integrally formed on a transmission case 28 of the transmission part. The recessed portion 30 comprises a continuous side wall 30*a* which is shaped to match with the bottom portion of the ladder beam structure 16 and a bottom wall 30*b* which is shaped to serve as a part of the upper wall of the transmission case 28. A plurality of bolts 32 are used for rigidly connecting the ladder beam structure 16 and the bank of the recessed portion 30 with an interposal of a suitable sealing member or gasket (not shown) therebetween. With this, it will be appreciated that the recessed portion 30 serves also as an oil pan for the engine part.

Designated by numerals 34, 36 and 38 are gears which are installed in the transmission case 28, and designated by numeral 40 is an under cover of the transmission case 28. As is seen in FIG. 2, the side wall 30*a* of the recessed portion 30 is formed with an oil draining hole which is plugged by a drain plug 42. A rear cover 44 is provided at a rear side of the power plant structure for housing therein a known gear mechanism by which the drive power of the crankshaft is transmitted to the gears 34, 36 and 38 in the transmission case 28. Designated by numeral 46 is a front cover fixed to a front side of the cylinder block 10.

Because of the provision of the ladder beam structure 16, the rigidity of the bearing cap sections 18 is increased and the vibration of the cylinder block skirt section 12 is suppressed or at least minimized. In addition, since the ladder beam structure 16 is rigidly connected or tightly bolted to the recessed portion 30 of the transmission case 28, the rigidity of the ladder beam structure 16 of itself is also increased thereby suppressing or at least minimizing vibration of its lower part. Furthermore, since the engine part is rigidly connected through the ladder beam structure 16 to the transmission part, the substantial sectional area of the engine part is enlarged increasing the geometrical (second) moment of inertia of the same. Thus, the rigidity of the engine against a torsional stress and that against a bending stress are increased. This unique construction of the power plant structure is effective in reducing the engine noise of frequency ranging from about 200 Hz to about 3 KHz.

In addition, since the engine part and the transmission part are compactly assembled in the abovementioned manner, the whole surface area (viz., the noise emitting area) of the power plant structure including these two parts is considerably reduced thereby much more effectively reducing the noise.

Figure 4:
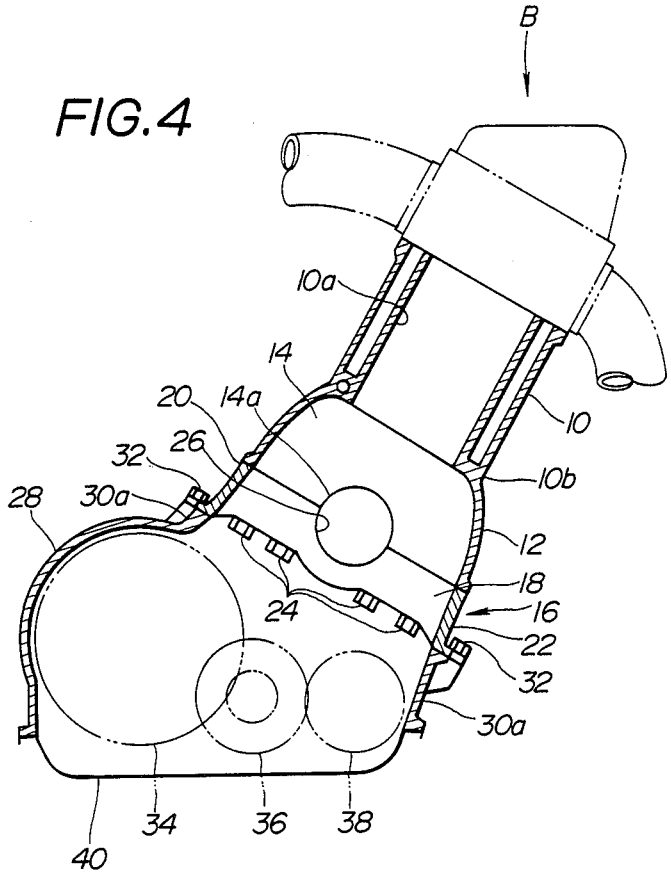
FIG. 4 is a view similar to FIG. 1, but showing a second embodiment of the present invention.

Referring to FIG. 4, there is shown a power plant structure "B" of a second embodiment of the present invention.

As is seen from the drawing, the power plant structure "B" of the second embodiment has substantially all parts of the structure "A" of the first embodiment except the bottom wall 30*b* of the recessed portion 30. That is, in the second embodiment, the under cover 40 of the transmission case 28 serves as an oil pan of the engine as well as an oil reservoir of the transmission.

Because of absence of the bottom wall 30*b*, the rigidity of the lower part of the ladder beam structure 16 is somewhat reduced as compared with the structure of the first embodiment. However, the reduction in the noise emission surface area caused by the absence of the bottom wall brings about a sufficient noise reduction.

Although the above-mentioned two embodiment "A" and "B" are directed to a power plant structure which includes the ladder beam structure 16, the present invention is also applicable to a power plant structure which does not include such a ladder beam structure.

Figure 5:
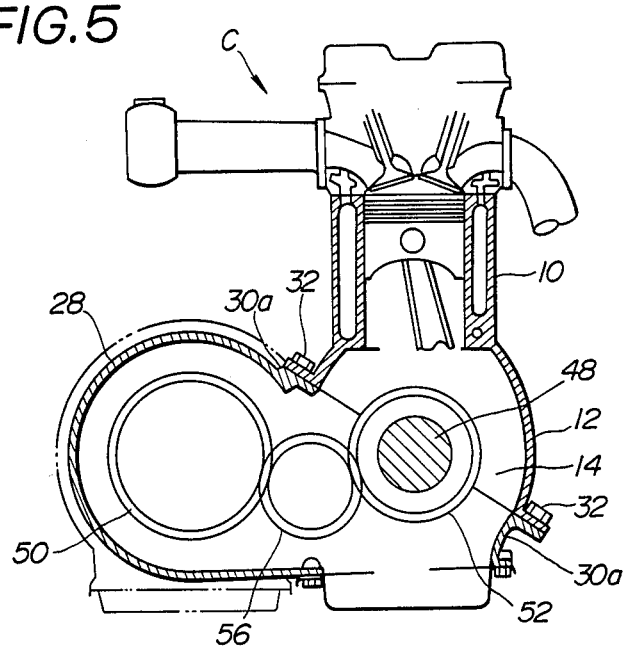
FIG. 5 is a front vertical sectional view of a power plant structure of a third embodiment of the present invenntion.
Figure 6:
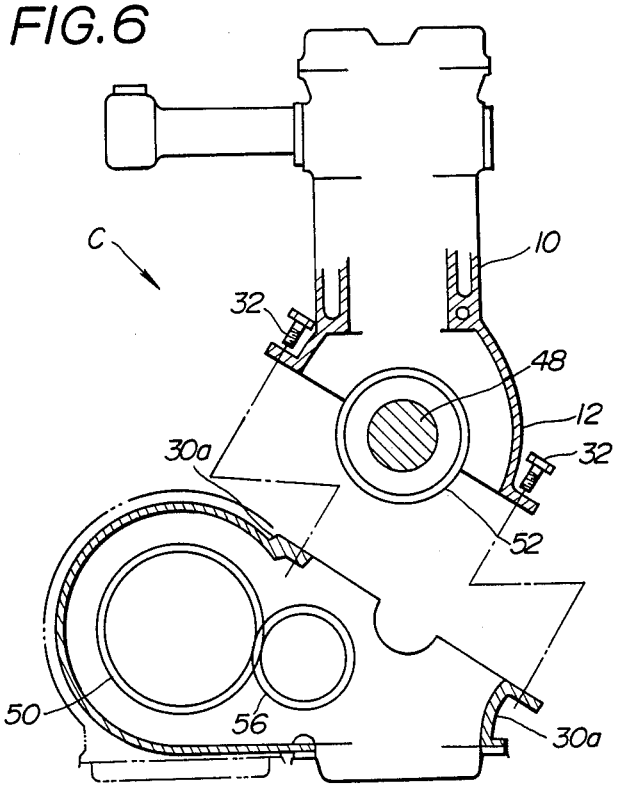
FIG. 6 is a view similar to FIG. 5, but showing a disassembled condition of the power plant structure of the third embodiment.
Figure 7:
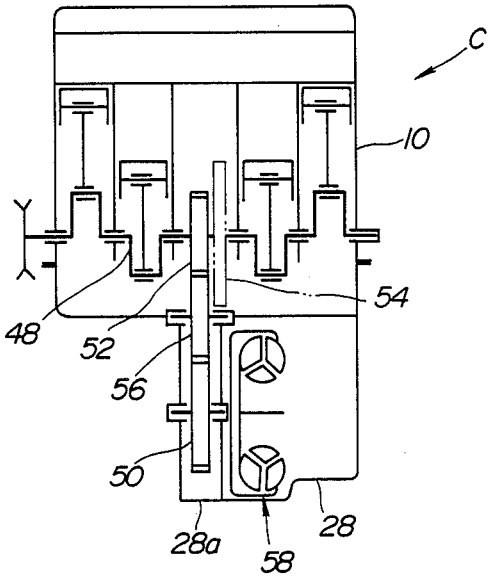
FIG. 7 is a schematically illustrated side sectional view of the power plant structure of the third embodiment.

Referring to FIGS. 5, 6 and 7, particularly FIG. 5, there is shown a power plant structure "C" of a third embodiment of the present invention, which generally comprises an engine part and an automatic transmission part. As is seen from the drawings, the power plant structure "C" does not use a ladder beam structure. That is, a mounting side wall 30*a* integrally formed on the transmission case 28 is directly connected, by means of bolts 32, to the skirt section 12 of the cylinder block 10 with interposal of a suitable gasket therebetween.

In this third embodiment, another measure is also employed for effectively transmitting the power of the crankshaft 48 to an input gear 50 of the transmission part. As is seen from FIG. 7, a crank gear 52 is secured to a central portion of the crankshaft 48 to rotate therewith. Designated by numeral 54 is a flywheel which is secured to the crankshaft 48 adjacent the crank gear 52. Engaged with the crank gear 52 is an idler gear 56 which is, in turn, engaged with the input gear 50 of the transmission part. As is seen from FIG. 7, the idler gear 56 and the input gear 50 are housed in a cover 28*a* mounted to the transmission case 28. The input gear 50 is connected to a torque converter 58 in a known manner. As is seen from FIG. 7, the idler gear 56 and the input gear 50 are housed in a cover 28*a* connected to the transmission case 28.

Because the crank gear 52 (viz., output gear) is connected to the central portion of the crankshaft 48, power-outputting from the crankshaft 48 is smoothly carried out with the forward and rearward sections of the crankshaft 48, with respect to the crank gear 52, being well balanced under rotation of the same. This contributes to an improvement in reducing the engine noise. Furthermore, in the third embodiment, assembly of the power plant structure "C" can be readily made because of usage of the gears 52, 56 and 50 as the power transmitting means from the crankshaft 48 to the transmission part. That is, even when the engine part is simply put on the transmission part, the crank gear 52 is automatically brought into engagement with the idle gear 56 in the transmission part. This will be well understood from FIG. 6 which shows the disassembled condition of the power plant structure of the third embodiment.

Figure 8:
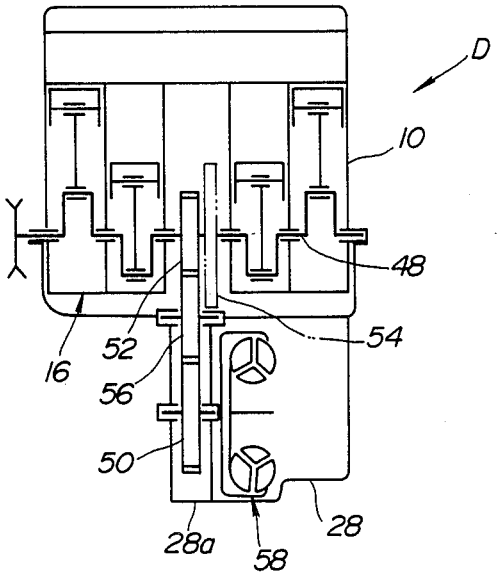
FIG. 8 is a view similar to FIG. 7, but showing a fourth embodiment of the present invention.
Figure 9:
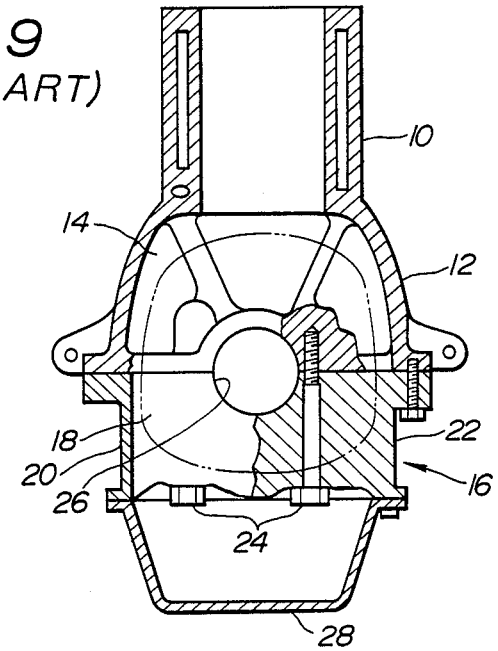
FIG.9 (PRIOR ART)
FIG. 9 is a front vertical sectional view of a conventional internal combustion engine which has been discussed hereinabove.
Figure 10:
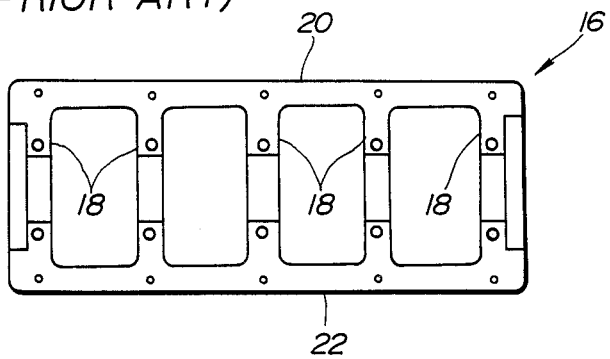
FIG.10 (PRIOR ART)
FIG. 10 is a plan view of a ladder beam structure applied to the conventional engine.
Figure 11:
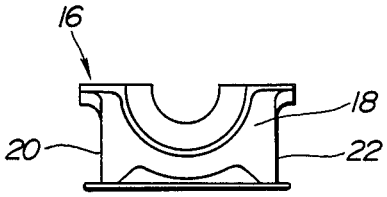
FIG.11 (PRIOR ART)
FIG. 11 is a front view of the ladder beam structure of FIG. 10.

Referring to FIG. 8, there is shown a power plant structure "D" of a fourth embodiment of the present invention, which is generally the same as that of the above-mentioned third embodiment "C" except that in the fourth embodiment, a ladder beam structure 16 is employed. That is, the ladder beam structure 16 is securely interposed between the bottom portion of the cylinder block 10 and the mounting side wall 30*a* of the transmission case 28 in substantially the same manner as that mentioned in the second embodiment "B" of FIG. 4. Because of usage of the ladder beam structure 16, the noise reduction of the power plant structure is much assured.

As is appreciated from the above, in accordance with the present invention, the cylinder block 10 of the engine part is directly or indirectly, but securely connected by bolts to the transmission case 28 permitting at least a part of the transmission case to serve as an oil pan of the engine part. Thus, the rigidity of the engine part against a torsional stress and that against a bending stress are both increased, so that the undesired engine noise caused by vibration of the skirt section 12 of the engine part can be reduced to a sufficiently small level. Particularly in the first, second and fourth embodiments "A", "B" and "D" of the invention, the noise reduction is quite effectively achieved due to the provision of the ladder beam structure 16. Furthermore, in the third and fourth embodiments "C" and "D", the power-outputting from the crankshaft 48 is effectively made because the crank gear 52 is connected to the well-ballanced central portion of the crankshaft 48. Furthermore, in these embodiments "C" and "D", the assembly of the power plant structure can be readily made because of use of the gears 52, 56 and 50 as the power transmitting means from the crankshaft 48 to the transmission part.

What is claimed:

1. A power plant structure of increased rigidity and reduced engine noise comprising:

an engine including a cylinder block which includes a lower skirt;

a mounting portion integrally formed on said transmission case to which the lower skirt of said cylinder block is mounted;

connecting means for securely connecting said lower skirt of said cylinder block to said mounting portion; and a part of said transmission case constituting a part of an oil pan of said engine upon mounting of said engine onto said mounting portion.

2. A power plant structure as claimed in claim 1, in which said mounting portion of said transmission case is shaped to match with the lower skirt of said cylinder block.

3. A power plant structure as claimed in claim 2, in which said connecting means comprises a plurality of connecting bolts.

4. A power plant structure as claimed in claim 3, further comprising a ladder beam structure which is tightly disposed between the bottom of said skirt of said cylinder block and said mounting portion of said transmission case, said ladder beam structure being so constructed and arranged as to increase the rigidity of said bottom portion and said mounting portion.

5. A power plant structure as claimed in claim 4, in which said ladder beam structure comprises:

a plurality of main bearing cap sections which are spaced from one another; and two side beam sections between which said main bearing cap sections are arranged in such a manner that longitudinal both ends of each bearing cap section are integrally connected to said side beam sections respectively.

6. A power plant structure as claimed in claim 5, in which each main bearing cap section is secured, by bolts, at its top portion onto each bearing bulkhead which is formed in a lower section of said cylinder block.

7. A power plant structure as claimed in claim 6, in which said skirt of the cylinder block is bulged outwardly and extends downwardly from a major part of said cylinder block to define thereinside an upper part of a crankcase.

8. A power plant structure as claimed in claim 7, in which said mounting portion of said transmission case is a recessed portion of the same, said recessed portion including:

a continuous side wall shaped to match with a bottom portion of said ladder beam structure; and a bottom portion shaped to serve as a part of an upper wall of said transmission case, whereby said recessed portion serves as an oil pan of said engine.

9. A power plant structure as claimed in claim 7, in which said mounting portion of said transmission case is a continuous side wall by which an opening of said transmission case is defined, said continuous side wall being shaped to match with a bottom portion of said ladder beam structure, so that upon assembly of the power plant structure, a bottom portion of said transmission case serves as an oil pan of the engine as well as an oil reservoir of the transmission.

10. A power plant structure as claimed in claim 3, further comprising:

a crank gear secured to a central portion of a crankshaft of said engine;

an idler gear engaged with said crank gear and rotatably housed in a cover attached to said transmission case; and an input gear engaged with said idler gear and rotatably housed in said cover, said input gear being connected to an input means of said transmission.

11. A power plant structure as claimed in claim 10, in which said mounting portion of said transmission case is a continuous side wall by which an opening of said transmission case is defined, said continuous side wall being shaped to match with a bottom portion of said cylinder block, so that upon assembly of the power plant structure, a bottom portion of said transmission case serves as an oil pan of the engine as well as an oil reservoir of the transmission.

12. A power plant structure as claimed in claim 10, further comprising a ladder beam structure which is tightly disposed between said skirt of said cylinder block and said mounting portion of said transmission case, said ladder beam structure being so constructed and arranged as to increase the rigidity of said bottom portion and said mounting portion.

13. A power plant structure as claimed in claim 12, in which said mounting portion of said transmission case is a continuous side wall by which an opening of said transmission case is defined, said continuous side wall being shaped to match with a bottom portion of said ladder beam structure, so that upon assembly of the power plant structure, a bottom portion of said transmission case serves as an oil pan of the engine as well as an oil reservoir of the transmission.

* * * * *